United States Patent [19]

Faltermeier

[11] 4,162,023

[45] Jul. 24, 1979

[54] DUST COVER FOR FLIP TOP OPENING CONTAINERS

[76] Inventor: Heinz J. Faltermeier, 2236 Washington Valley Rd., Martinsville, N.J. 08836

[21] Appl. No.: 953,648

[22] Filed: Oct. 23, 1978

[51] Int. Cl.[2] ..... B65D 51/22

[52] U.S. Cl. ..... 220/258; 220/270

[58] Field of Search ..... 220/258, 270–274, 220/94

[56] References Cited

U.S. PATENT DOCUMENTS

| | | | |
|---|---|---|---|
| 3,204,805 | 9/1965 | May | 220/258 |
| 4,125,203 | 11/1978 | Sorari | 220/258 |

*Primary Examiner*—George T. Hall

[57] ABSTRACT

There is disclosed a dust cover which has multiple layers for integrating the ring pull of a flip top opener, which permits a user to simultaneously remove the cover and opener, and which utilizes the escaping carbonated gas to assist in removal of the cover.

7 Claims, 4 Drawing Figures

DUST COVER FOR FLIP TOP OPENING CONTAINERS

BACKGROUND OF THE INVENTION

Figure 2:
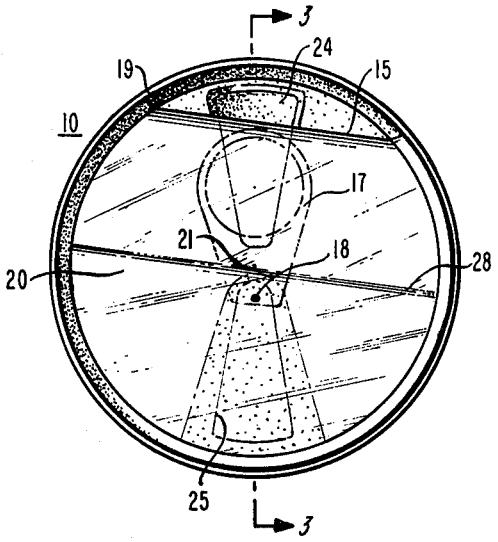

This invention relates to containers or receptacles for storing and dispensing food products, and more particularly, it relates to covers and sealing arrangement for such containers.

Metalized containers for storing and dispensing liquids are well known, as are the familar "flip-top" openers atop of these containers. Such arrangements although economical and efficient have distinct drawbacks. For example, the sight of discarded ring-pull openers litters our countryside and has become an ecological problem of sizeable proportions. Also, these containers, although advertised as vessel from which the user can drink, are not sanitary. These cans are exposed during shipment and sale to various unsanitary abuses. By way of one example, the reader can appreciate the fact that cans are stacked in display cases by hand and as such are subjected to contamination from humans.

An additional drawback of these flip-top opening arrangements is the opener itself. The pull required to initially start the tab opening as well as the ring provided for the single digit grasp, is quite simply an inefficient and cumbersome scheme.

STATEMENT OF THE INVENTION

Accordingly, applicant has overcome the foregoing drawbacks in a single novel embodiment which is added to conventional metalized containers with flip-top openers to preserve and insulate the containers top from contamination. In addition, the novel cover is integrated with the ring portion of the conventional flip-top opener to create an improved opening arrangement.

The novel cover embraces the upper portion of the sides of the container and seals the entire top surface. The cover contains a pocket into which fingers can be inserted to remove the cover easily. Advantageously, as the cover is lifted to "crack" the tab, carbonated gas escapes to fill the area under the novel cover exerting pressure. This gas pressure assists the user in lifting the cover.

The cover after removal from the top of a can carries with it the familar "ring bull". The cover may be stored temporarily by placing the cover on the bottom of the can. If it is desired to reseal the can the cover can be placed back on the can top with a depressed matching detent molded into the cover in alignment over the can drinking aperture.

Figure 1:
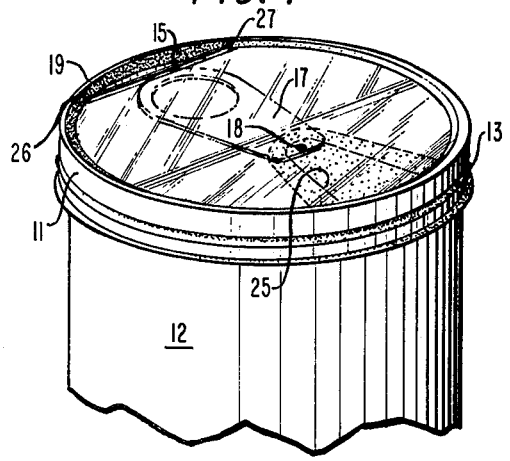
Figure 3:
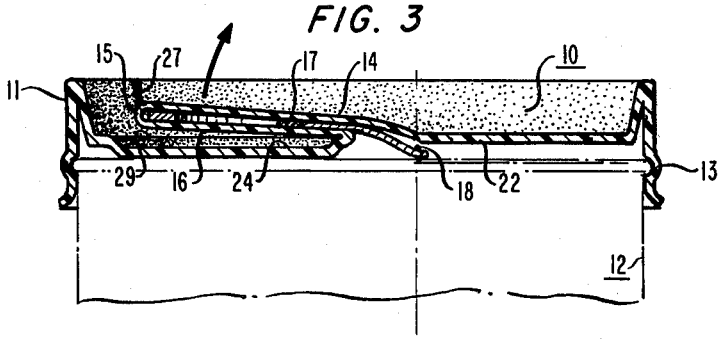

The foregoing advantages and features of this invention as well as others can be appreciated from the following detailed description which refers to the drawing containing:

FIG. 1 a perspective view of the cover showing the pocket positioned in the upper left quadrant;

FIG. 2 a top view of the cover which is transparent enabling the viewer to see the conventional pull-tab;

FIG. 3 a view of section taken along section line 3—3 of FIG. 2; and

Figure 4:
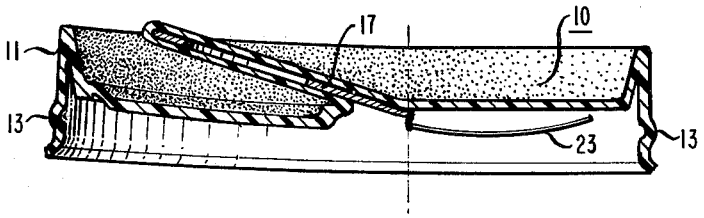

FIG. 4 a sectional view of the cover showing it removed from the can and demonstrating how the pull-tab is retained with the cover.

With reference to FIGS. 1 and 2, the dust cover 10 is shown having a circumferential skirt 11 encircling container 12. Skirt 11 embraces container 12 so as to create a tight fit and has conforming side wall contours 13 which conform to the shape of container 12.

Dust cover 10 has multiple layers which can best be appreciated in sectional view FIG. 3. As shown therein surface 14 covers substantially 80% of the top surface of container 12 and contiguously, surface 16 joins edge surface 15 to integrate pull tab 17. More particularly tab 17 which is connected at pivot securement 18 is sandwiched between surfaces 16 and 14 for most of its free length and is held immobile except for motion as part of the integrated structure including surfaces 15, 16 and 14.

Before considering in greater detail the structure of dust cover 10 it might be opportune to consider how it is used in practise. To remove cover 10 from container 12 the user (not shown) simply insets one or two fingers under edge surface 15 lifting it in the direction of the arrow shown in FIG. 3. This action pulls up the circumferential shirt 11 near the area marked in FIGS. 1 and 2 as contact point 19. It should be observed particularly with respect to FIG. 2 that edge surface 15 is oriented along a chord formed on the circular surface 20 of container 12 such that a perpendicular line (not shown) from the cord formed by edge surface 15 drawn to the center 21 is displaced approximately 10 degrees from section line 3—3 (also center). This has been determined a sufficient angle to start skirt 11 before incurring the initial resistance of the pull-tab 17.

Advantageously, as edge surface 15 is pulled upwardly the edge 22 of pull-tab 17 (see FIG. 3) separates from the top of container 12 allowing carbonated gases to expand under dust cover 10. Although this expansion is not necessary to the working of the invention, it is useful in that the escaping gas exerts pressure under cover 10 such as to allow the removal of the cover with far less exertion.

FIG. 4 shows cover 10 removed from container 12. The disengaged free edge 23 of pull-tab 17 can be seen extended below the surface of cover 10. Importantly, tab 17 is retained by cover 10 and thus the problem of discarded pull-tabs is eliminated. Cover 10 can be placed on the bottom (not shown) of container 12 and discarded along with container 12, if so desired.

If it should be desired to reseal container 12 the cover 10 can be removed from its temporary storage on the bottom of container 12 and placed on top. Cover 10 contains a detent 24 in matching alignment with the exposed hole 25 formed when pull-tab 17 is removed. A portion of detent 24 is shown at the top of FIG. 2 and detent 24 is shown in profile in FIG. 3. Thus cover 10 is turned approximately 180° from the position shown in FIGS. 1 and 2 to securely seal hole 25.

Returning once again to the structure of cover 10 it is necessary to note additional details for completeness of this disclosure. With reference to FIG. 1 edge surface 15 is, of course, free along its length atop container 12, but at corners 26 and 27 surface 15 is secured to skirt 11 so that a lifting force, as previously discussed, will engage and remove skirt 11 from container 12. Finally, in FIGS. 1 and 2 phantom line 28 refers to the edge surface formed at the juncture of surfaces 16 and 29 (FIG. 3).

What is claimed is:

1. A dust cover for flip-top opening containers having a pull-tab comprising a skirt member consisting of a substantially flat narrow band of plastic material joined at its end to form a ring; and a multi-layered substantially flat-top surface member having a first top layer contiguously joined along a majority of its edge to a top edge of said ring and forming free unconnected edge; a second layer contiguous with said top layer joined along said free edge and folded thereunder retaining between said top layer and said second layer said pull-tab to form a multi-layer retention member.

2. The invention recited in claim 1 further including a third layer joined to said second layer at a free edge thereof and joined to said top edge of said ring forming thereby a pressure tight dust cover which captures gases released by said container upon upward movement of said retention member.

3. The invention recited in claim 2 further including in said third layer a shaped downwardly extending dentent surface for sealing aperatures in said container.

4. The invention of claim 2 wherein said skirt member contains at least one inwardly shaped circumferential groove for gas tight sealing of said container by said cover.

5. The invention of claim 1 wherein the free edges of said retention member are joined to said edge of said ring forming a chord with reference the circular surface of said container such that a perpendicular line therefrom through a center of said circular surface is not in alignment with a centerline through said flip-top opening pull-tab drawn through the same center.

6. A sanitary plastic cover for a metalized container having a flip-top opener with a pull-tab comprising a circular ring member adapted to form a skirt about said container, said member member consisting substantially of a relatively narrow band joined at ends thereof to form said ring member, a multi layered retention member comprising an upper and lower surface members between which said pull-tab is immovable retained, and ends of said upper and lower surface members being both joined at opposite sides to said ring member.

7. The invention recited in claim 6 further including additional layers joined to said upper and lower surface members and to said ring member forming thereby a continguous cover with a downwardly extending skirt which is pressure tight up to pressures normally encountered in containers holding carbonated beverages.

* * * * *